US005941514A

United States Patent [19]

Burcaw

[11] Patent Number: 5,941,514

[45] Date of Patent: Aug. 24, 1999

[54] TRUSS ELEMENT POSITIONING CLAMP

[76] Inventor: Terry E. Burcaw, 11014 Lapaz Ct., Spring Hill, Fla. 34608

[21] Appl. No.: 09/018,037

[22] Filed: Feb. 3, 1998

[51] Int. Cl.[6] ..... B30B 3/02

[52] U.S. Cl. ..... 269/37; 29/213.1

[58] Field of Search ..... 29/281.3, 203, 29/204, 205, 206, 208; 269/236, 234, 307, 303, 304, 305, 99, 910

[56] References Cited

U.S. PATENT DOCUMENTS

| | | | |
|---|---|---|---|
| 2,850,926 | 9/1958 | Jobe | 269/234 |
| 5,085,414 | 2/1992 | Weaver | 269/37 |
| 5,608,970 | 3/1997 | Owen | 269/99 |
| 5,816,300 | 10/1998 | Rogers | 269/236 |

*Primary Examiner*—David A. Scherbel
*Assistant Examiner*—Daniel G. Shanky
*Attorney, Agent, or Firm*—A. W. Fisher, III

[57] ABSTRACT

A truss element positioning clamp for use on a truss fabrication table to position a truss element in a preselected position comprising a clamp chassis slideably disposed over a clamping channel formed in the surface of the truss fabrication table including a truss stop operatively disposed on the upper surface of the clamp chassis to selectively engage and position the truss element of a truss having at least one guide member formed on the clamp chassis and disposed within the clamping channel to prevent rotation of the truss element positioning clamp relative to the clamping channel and a clamp stop movably coupled to the clamp chassis extending into the interior of the clamping channel and selectively movable between a first position and a second position such that when the clamp stop is in the first position the clamp stop is disengaged from the inner surface of the clamping channel whereby the truss element positioning clamp may be positioned longitudinally along the length of the clamping channel and when the clamp stop is in the second position the clamp stop engages the inner surface of the clamping channel preventing movement of the truss element positioning clamp to retain the truss element at a selected position on the surface of the truss fabrication table.

41 Claims, 12 Drawing Sheets

TRUSS ELEMENT POSITIONING CLAMP

BACKGROUND OF THE INVENTION

1. Field of the Invention

A truss element positioning clamp for use on a truss fabrication table to position a truss element in a preselected position.

2. Description of the Prior Art

Numerous jigs and other positioning or alignment systems have been developed for use in fabricating or assembling trusses.

U.S. Pat. No. 5,608,970 teaches a quick release clamp for clamping frame members of a roof truss frame on a roof truss frame table to permit fabrication of roof truss frames. The clamp comprises a moveable clamping jaw, a threaded clamping shaft, and a threaded clamping nut. The jaw is attached to one end of the shaft so that it can rotate with the shaft when the shaft is rotated. The shaft has a stop at the opposite end to the jaw. The nut is screw-threadably attached to the shaft between the jaw and the stop. The jaw is arranged to pass through an aperture in a member to which the clamp is to be attached. The aperture may in fact comprise a slot In a track member. The jaw and the aperture are shaped so that in one angular rotated position of the jaw relative to the aperture the jaw can pass through the aperture but in another angular rotated position relative to the aperture the jaw cannot pass through the aperture. The clamp permits quick release by untightening the nut. In this case, the jaw is moved away from the member to which it is clamped as the nut threadably moves on the shaft. When the nut engages the stop the shaft will be rotated with the nut and thereby rotate the jaw angularly so that it can be drawn through the aperture so that the clamp can then be removed from the member. The clamp can be used as an engagement surface for locating the position of frame members in a roof truss frame on a roof truss frame table used for fabricating the roof truss.

U.S. Pat. No. 5,342,030 shows an assembly table for roof trusses with open parallel channels located on the table which contain jig stops movable along their respective channels by means of a connector head which can be raised and lowered from a gantry carriage located on a gantry which spans the table and runs along tracks located on each side of the table. The respective movements and operation of the gantry, gantry carriage and connector head are controlled by a computer.

U.S. Pat. No. 5,085,414 comprises a jig for forming wooden trusses including a table traversed by upwardly opening channels in which stop units are received to define the structure to formed. Each stop unit includes 2 stop and a clamp member which are adjustable to clamp elements of the channel between them and thereby fits the location of the stop along the length of the channel in which it is received. Each channel carries a scale at one side and the clamp member carries an index mark to be aligned with positions on the scale for accurately locating the stop.

U.S. Pat. No. 4,875,666 teaches a clamp for holding lumber which is used to form roof trusses. A plurality of clamps are placed on a work table oriented to constrain plural pieces of lumber forming the truss until truss plates attach ends of adjacent pieces of lumber. The clamp includes an inner and outer sleeve, the inner sleeve telescopes with respect to the outer sleeve and a spring bias connection exists between the inner and outer sleeve through a threaded shaft which causes the inner sleeve to telescope so that imperfections in the lumber can be accounted for and several Identically configured trusses can be formed without removing the clamps from the table.

U.S. Pat. No. 3,367,010 shows a jig for positioning and holding truss members during assembly of a roof truss comprising a series of rails mounted on a support table and on which the truss members are placed, some of the rails being adjustable relative to others and carrying adjustable stops and cam means to locate the truss members in a desired pattern and clamp the truss members together prior to the application of gusset plates to permanently join the truss members. A removable table section permits expansion of the jig to accommodate larger trusses.

SUMMARY OF THE INVENTION

The present invention relates to a truss element positioning clamp for use on a truss fabrication table to position individual truss elements at selected positions on the truss fabrication table to fabricate or assemble a truss. The truss element positioning clamp is slideably disposed on the truss fabrication table over a clamping channel or slot formed in the truss fabrication table. The truss element positioning clamp comprises a substantially flat clamp chassis having a truss stop formed in the upper surface thereof to engage and position an individual truss element at a selected location on the surface of the truss fabrication table during fabrication of the truss.

At least one guide member is formed on the lower surface of the clamp chassis to be slideably received by the clamping channel to preventing rotation of the truss element position clamp relative to the clamping channel while allowing movement of the truss element positioning clamp longitudinally along the clamping channel. A clamp stop is movably coupled to the clamp chassis and extends downward into the clamping channel to selectively engage the inner surface of clamping channel to prevent movement of the truss element positioning clamp longitudinally along the clamping channel.

The clamp stop is movable between a first position where the clamp stop is disengaged from the inner surface of the clamping channel and a second position where the clamp stop engages the inner surface of the clamping channel through the rotation of a cam mechanism.

In the preferred embodiment of the present invention, the cam mechanism comprises a handle movable through a plane parallel to the upper surface of the clamping chassis attached to the upper portion of a substantially vertical shaft rotatably coupled to the clamp chassis and a stop member comprising a lobe of substantially circular horizontal cross section attached to the lower portion of the substantially vertical shaft. The vertical axis of the stop member is in eccentric alignment with the vertical axis of the substantially vertical such that when the substantially vertical is rotated the peripheral edge of the stop member engages a side of the clamping channel with a progressively non-tangential angle of force between the stop member and the side of the clamping channel.

In an alternative embodiment of the present invention, the substantially vertical shaft includes a collar formed in the upper end of thereof including a progressively tapered cross section. The substantially vertical shaft is disposed within a second collar of complimentary tapered cross section formed on the upper surface of the clamp chassis such that rotation of the substantially vertical shaft is translated into movement of the substantially vertical shaft along the vertical axis and perpendicular to the surface the clamping chassis. AS in the preferred embodiment, the substantially vertical shaft extends downward through the clamping chassis and into the clamping channel terminating in a clamp stop. In the alternative embodiment, a substantially flat clamp stop is formed on the lower end of the substantially vertical shaft. Through selective rotation of the handle and substantially vertical shaft, the substantially vertical shaft is drawn upward through the clamping chassis causing the clamp stop to engage the lower edges of the slats forming the truss fabrication table or the lips formed in the clamping channel thereby preventing movement the truss element positioning clamp relative to the clamping channel.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
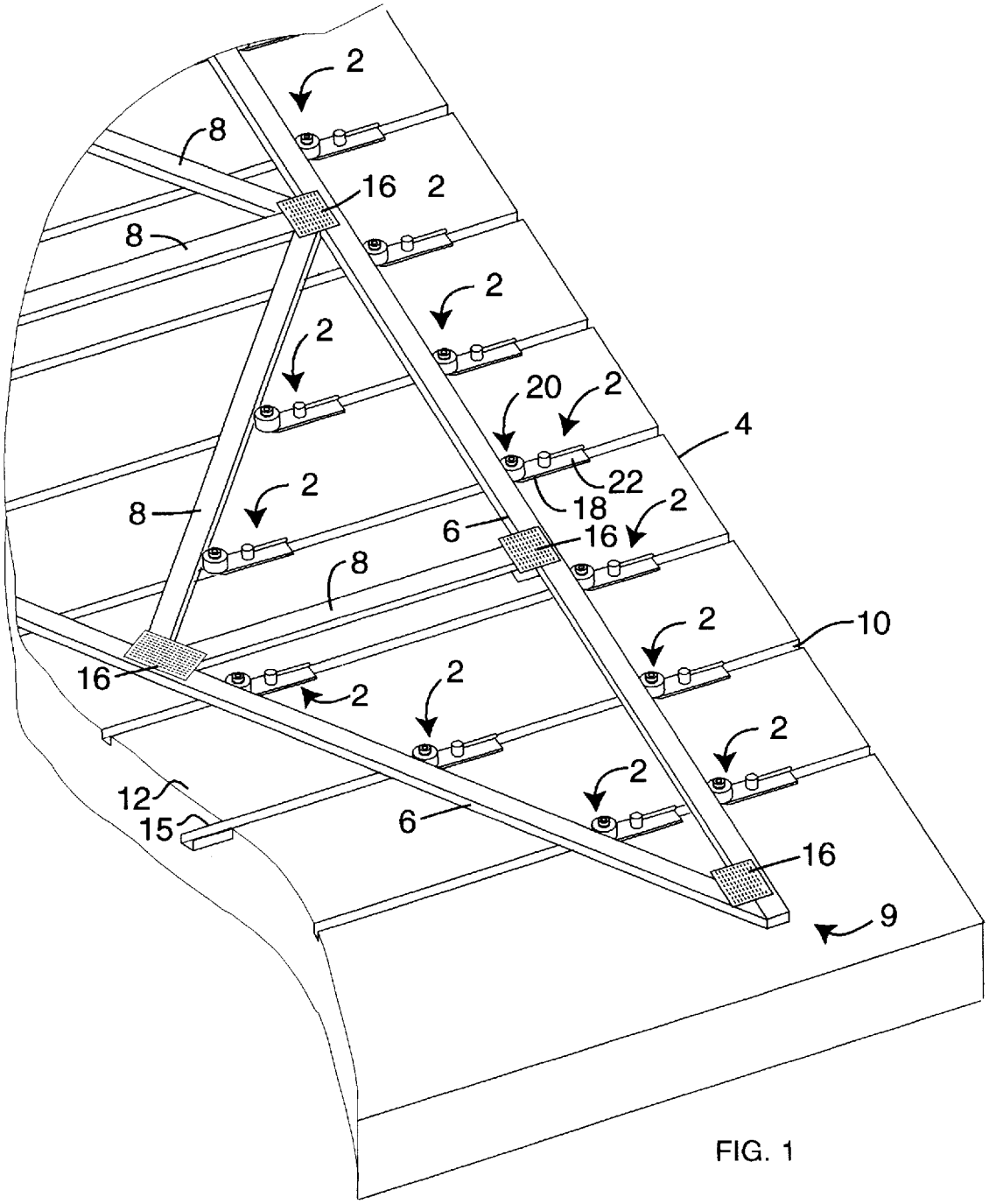
FIG. 1 is a perspective of a plurality of truss element positioning clamps of the present invention in combination with a truss operatively disposed on a truss fabrication table.
Figure 2:
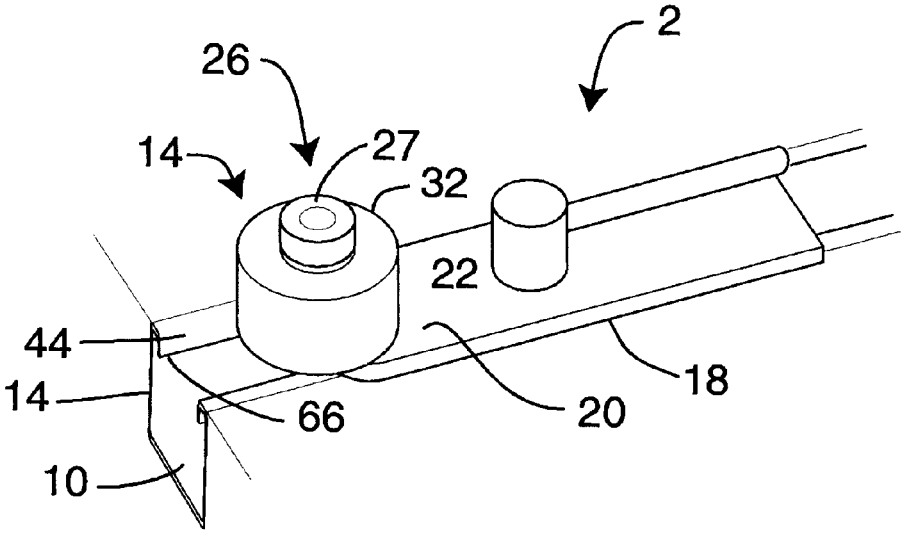
FIG. 2 is a perspective view of the truss element positioning clamp of the present invention.

As shown in FIGS. 1 and 2, the present invention relates to a truss element positioning clamp generally indicated as 2 for use on a truss fabrication table 4 for the purpose of positioning truss elements or chords 6 and webs 8 of the truss generally indicated as 9 during the fabrication or assembly process. The truss element positioning clamp 2 is slideably disposed on the truss fabrication table 4 over a corresponding clamping slot or channel 10 formed in the upper surface 12 of the truss fabrication table 4 and includes a truss stop generally indicated as 14 to engage the chord 6 or the web 8 of the truss 9. A metal channel sheath or liner 15 may be disposed with the clamping slot or channel 10 flush with the upper surface 12 of the truss fabrication table 4. Alternatively, the clamping channels 10 may be formed by spaces between the vertical edges of slats (not shown) spaced at regular intervals across the table forming the surface of the truss fabrication table 4. As described in greater detail below, the truss element positioning clamp 2 further includes a clamp stop to selectively engage the inner surfaces of the clamping slot 10 to secure the truss element positioning clamp 2 at the desired position on the upper surface 12 of the truss fabrication table 4.

During the typical truss fabrication or assembly process, truss element positioning clamps 2 are positioned longitudinally along corresponding clamping channels 10 at predetermined positions corresponding to the desired intersection between the chords 6 and webs 8 of the truss 9 in the finished configuration. Individual chord 6 and web 8 elements are then placed on the truss fabrication table 4 in contact with the truss element positioning clamps 2 in order to insure proper placement and alignment of each web 8 and chord 6. Gusset plates 16 Including integral nails or other fastening means 26 are then placed above and beneath the intersection between the chords 6 and or webs 8 of the truss 9 and compressed into the chord 6 and web 8 of the truss 9 by a pinch roller (not shown) traveling across the surface of the truss fabrication table 4 on a gantry (not shown) to secure the chords 6 and webs 8 together to form the truss 9.

Figure 3:
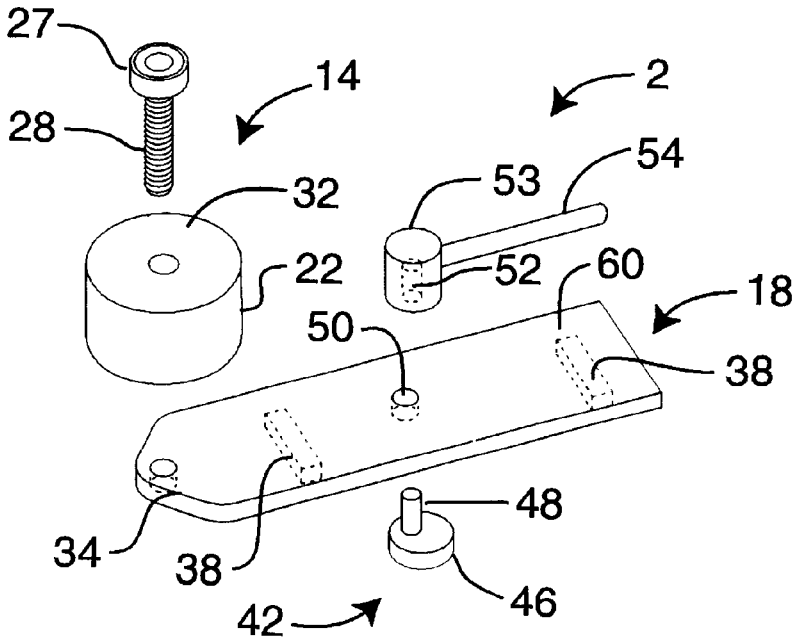
FIG. 3 is an exploded view of the truss element positioning clamp of the present invention.
Figure 4:
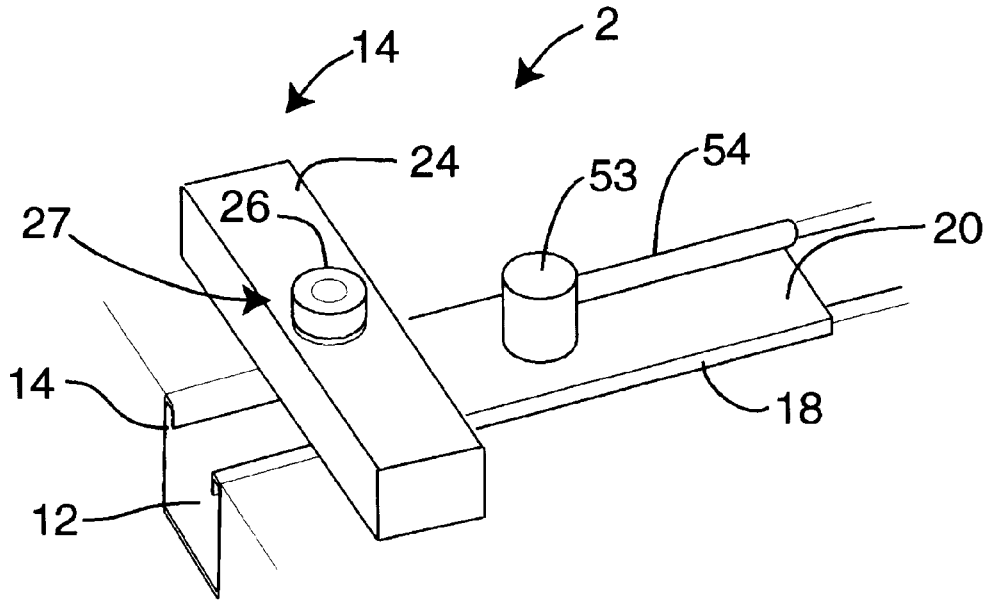
FIG. 4 is a perspective view of an alternate embodiment of the truss element positioning clamp of the present invention.
Figure 5:
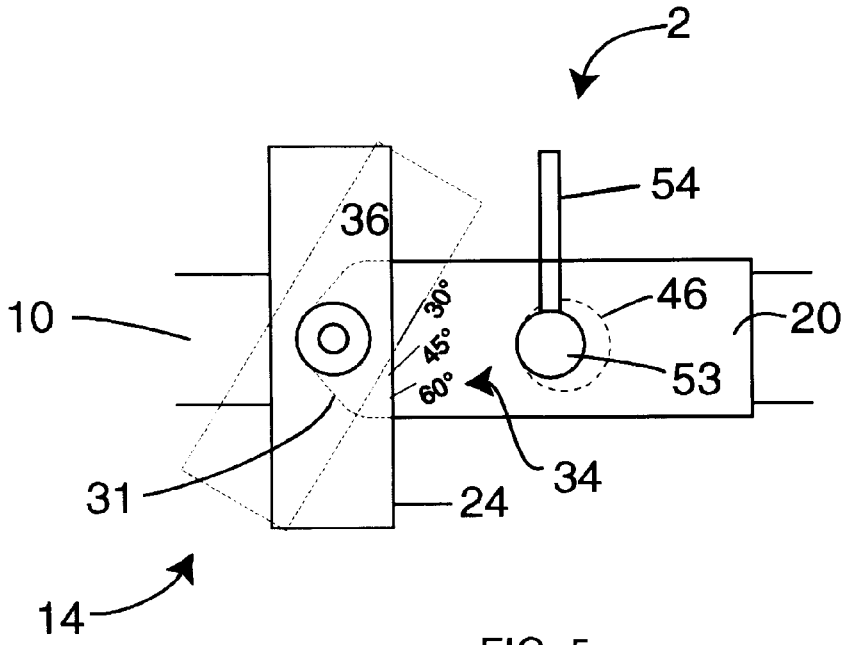
FIG. 5 is a top view of the truss element positioning clamp of the present invention shown in FIG. 4.

As shown in FIGS. 1 through 3, the truss element positioning clamp 2 includes a substantially flat clamp chassis 18 to be disposed over the opening of a corresponding clamping channel or slot 10. The truss stop 14 is coupled to the substantially flat clamp chassis 18 to engage and position chords 6 and webs 8 during fabrication of a truss 9. AS shown in FIGS. 3 through 5, the truss stop 14 comprises a substantially cylindrical bobbin 22 (FIG. 3) or a substantially rectilinear block 24 (FIGS. 4 and 5) rotatably coupled to the substantially flat clamp chassis 18 and held in place by a fastening means generally indicated as 26 comprising an enlarged head 27 and an elongated externally threaded member 28 received by a channel 29 in the substantially cylindrical bobbin 22 or the substantially rectilinear block 24 and a threaded aperature 30 formed in one end portion of the substantially flat clamp chassis 18.

Figure 6:
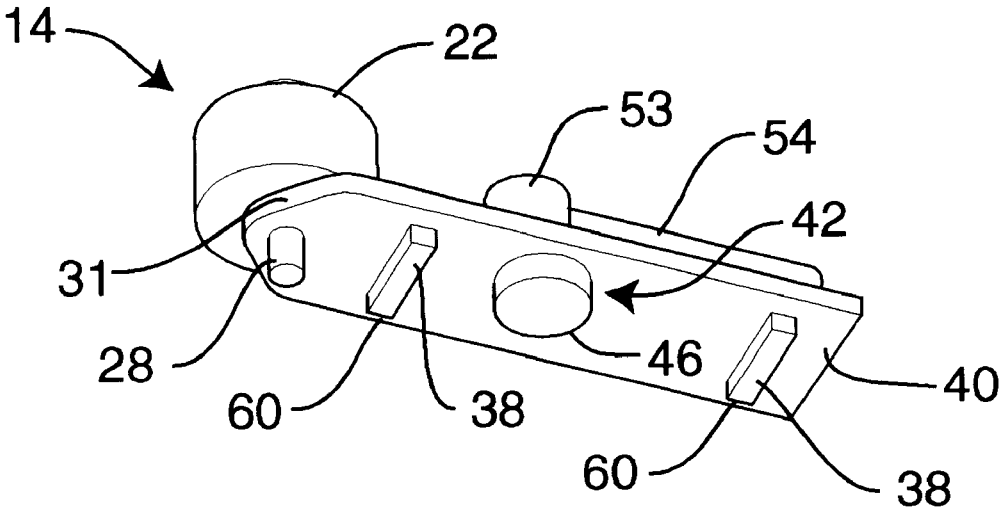
FIG. 6 is a bottom view of the truss element positioning clamp of the present invention shown in FIGS. 2 and 3.

As best shown in FIG. 6, the side surface or edges 31 of the outer end portion of the substantially flat clamp chassis 18 are shaped or beveled inward toward the fastening means 26 to avoid contact between the substantially flat clamp chassis 18 and a chord 6 or web 8 element of a truss 9. Where a substantially cylindrical bobbin 22 is utilized, it is generally desirable to provide a tolerance between the enlarged head 27 of the fastening means 26 and the upper surface 32 of the substantially cylindrical bobbin 22 such that the substantially cylindrical bobbin 22 freely rotates about the fastening means 26. In such a configuration, the substantially cylindrical bobbin 22 may function as a roller thereby facilitating the placement of larger chords 6 and webs 8.

As shown in FIG. 5, where the truss stop 14 includes the substantially rectilinear block 24, the substantially rectilinear block 24 may rotate freely about the fastening means 26 or may be selectively rotated to a predetermined angle corresponding to the angle of the chord 6 or web 8 the truss 9 is intended to engage. In such applications, the fastening means 26 may be tightened such that the substantially rectilinear block 24 is compressed between the enlarged head 27 of the fastening means 26 and the upper surface 20 of the substantially flat clamp chassis 18 to prevent further rotation of the substantially rectilinear block 24. Indicia generally indicated as 34 may be inscribed in the upper surface 20 of the substantially flat clamp chassis 18 to facilitate the alignment of substantially rectilinear block 24 to the proper angle relative to the substantially flat clamp chassis 18. As shown in FIG. 5, splines or ridges generally indicated as 36 may be formed in the lower surface of the substantially rectilinear block 24 and the upper surface 20 of the substantially flat clamp chassis 18 to provide a tactile and discrete selection of angle and to provide greater resistance to subsequent rotation of the substantially rectilinear block 24. It should be further appreciated that the truss stop 14 of the present invention may include other structure in combination with or in place of the substantially cylindrical bobbin 22 or the substantially rectilinear block 24 in order to adapt the truss element positioning clamp 2 to specialized truss materials or fabrication techniques.

Figure 7:
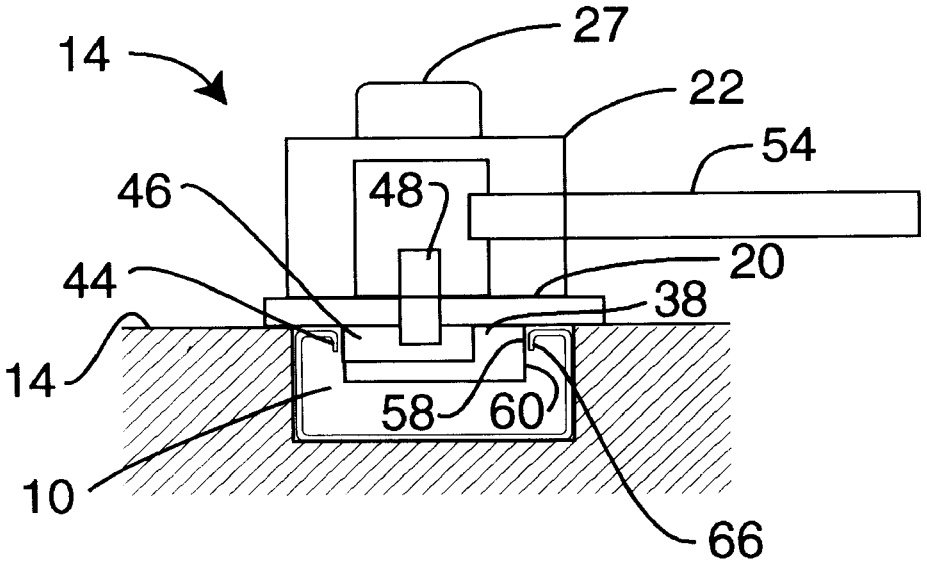
FIG. 7 is an end view of the truss position clamp of the present invention shown in FIGS. 2 and 3.

As shown in FIGS. 3, 6 and 7, one or more guide member each indicated as 38 is formed in the lower surface 40 of the substantially flat clamp chassis 18 and are slideably received by the clamping channel or slot 10 to prevent rotation of the truss element positioning clamp 2 while permitting the unrestricted linear or longitudinal movement of the truss element positioning clamp 2 across the upper surface 20 of the truss fabrication table 4 along the corresponding clamping channel or slot 10.

As best understood with reference to FIGS. 3, 7, 8, and 9, a clamp stop generally indicated as 42 is rotatably coupled to the bottom portion of the substantially flat clamp chassis 18 and extends downward into the interior of the clamping slot 10 to selectively engage the inner or side surface 44 of the clamping slot 10 to selectively secure the truss element positioning clamp 2 within the corresponding clamping channel or slot 10. In the preferred embodiment of the present invention, the clamp stop 42 comprises a circular circular cam lobe 46 eccentrically disposed on the lower end of a shaft 48 rotationally disposed in an opening 50 formed in the substantially flat clamp chassis 18 and received by a socket 52 formed in hub 53 formed in one end portion of a handle 54.

Figure 8:
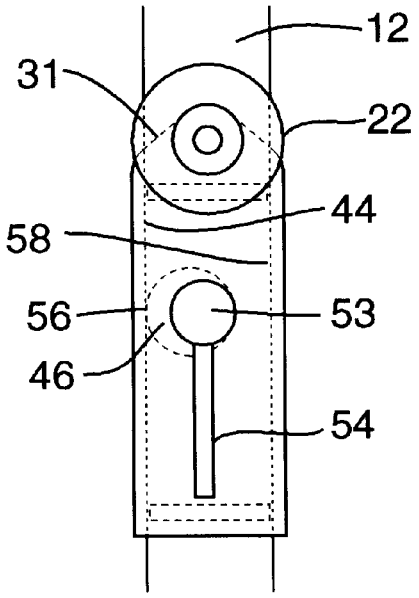
FIGS. 8 and 9 show top views of the truss element positioning clamp of the present invention shown in FIGS. 2 and 3 depicting operation of the clamp stop.
Figure 9:
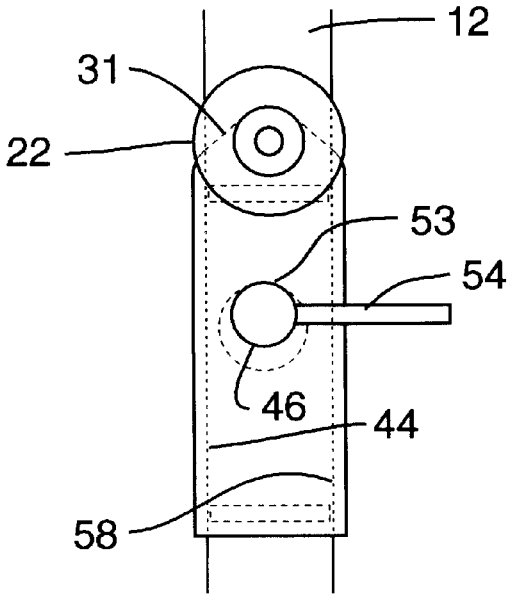
Figure 10:
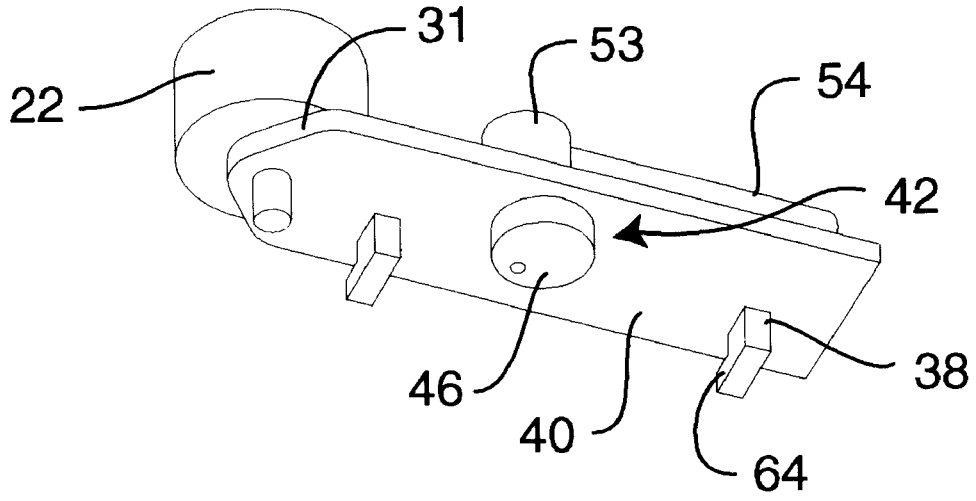
FIGS. 10 and 11 show bottom views of the truss element positioning clamp of the present invention shown in FIGS. 2 and 3 depicting alternate embodiments of the guide members.
Figure 11:
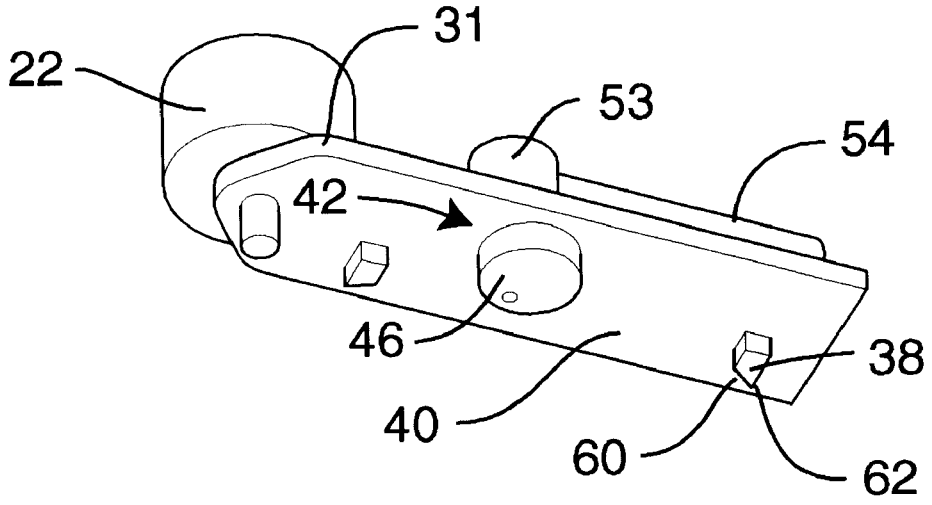
Figure 12:
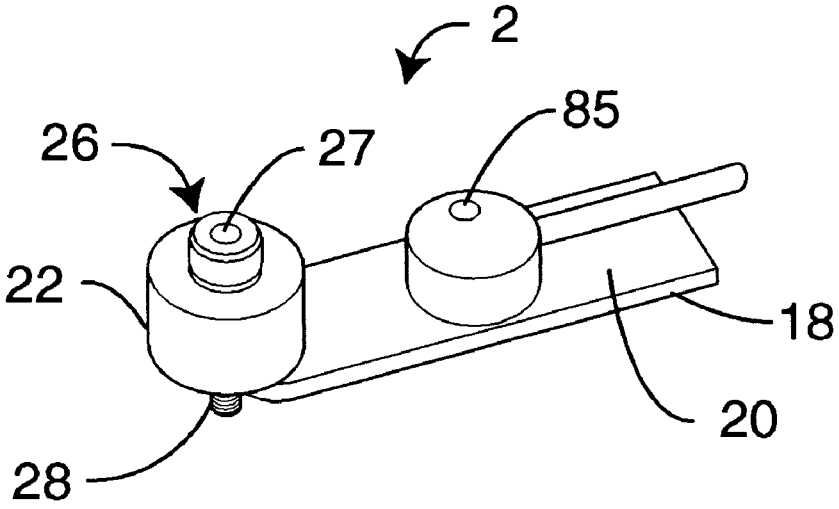
FIG. 12 is a perspective view of another alternate embodiment of the truss element positioning clamp of the present invention.
Figure 13:
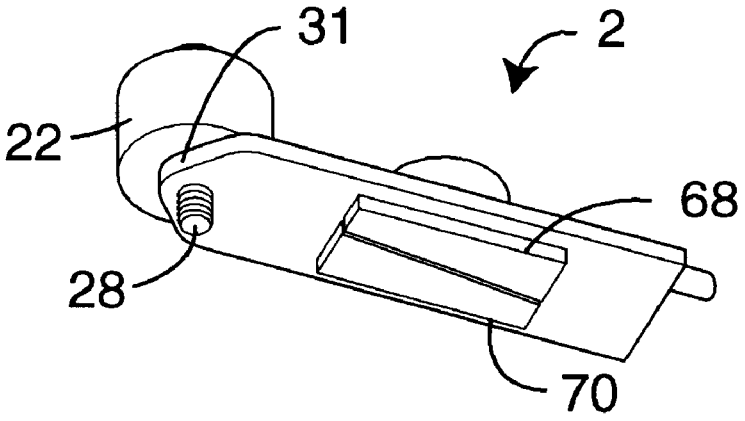
FIG. 13 is a bottom view of the truss element positioning clamp of the present invention shown in FIG. 12.
Figure 14:
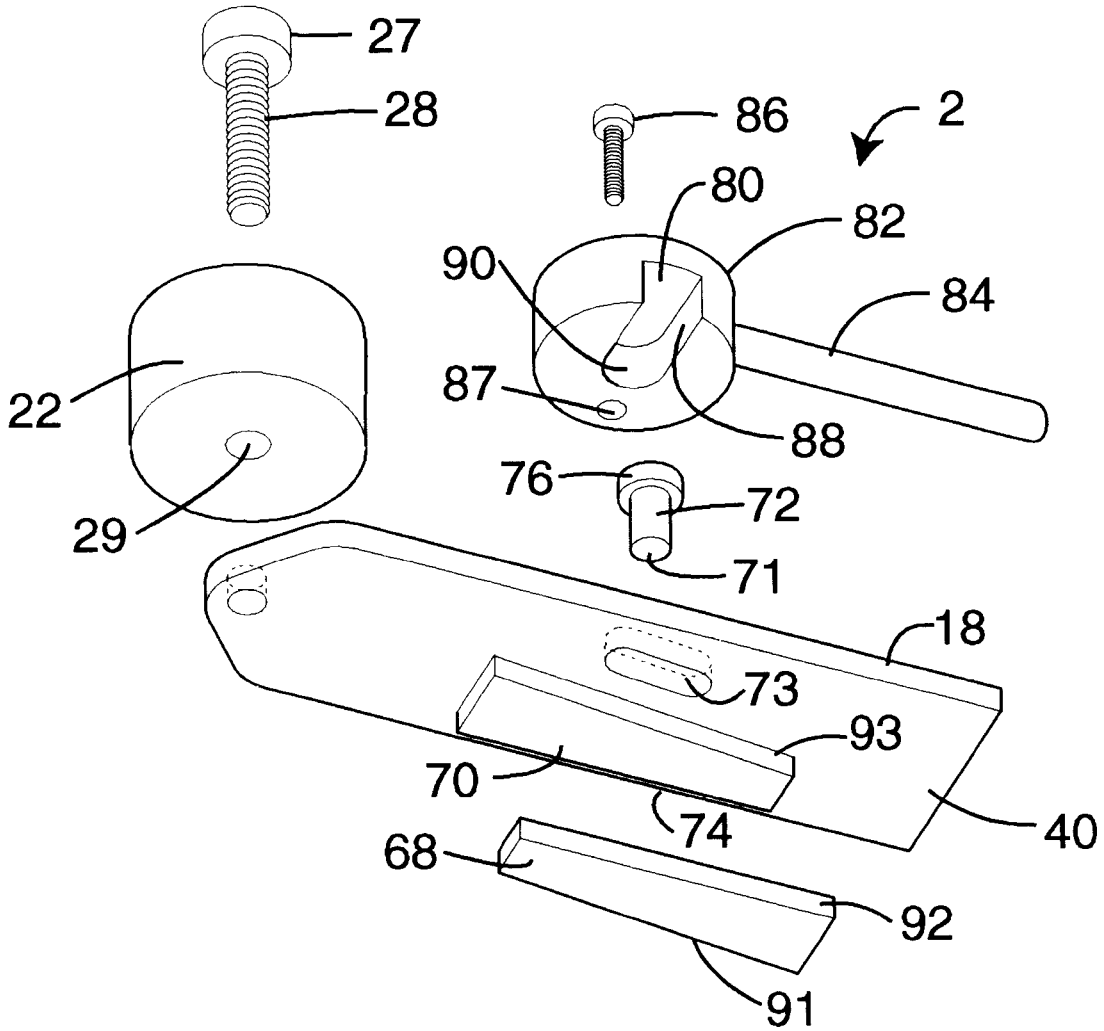
FIG. 14 is an exploded view of the truss element positioning clamp of the present invention shown in FIGS. 12 and 13.

As best shown in FIGS. 8 and 9, through rotation of the handle 54, the circular cam lobe 46 is moved between a first position (FIG. 8) wherein the outer edge or surface 56 of circular cam lobe 46 is disengaged from the inner surface or side 44 of the clamping channel or slot 10 and a second position (FIG. 9) wherein the outer edge or surface 56 engages the inner surface or side 44 of the clamping channel or slot 10 thereby causing a corresponding engagement of the opposing inner surface or side 58 of the clamping channel or slot 10 by the outer edge or surface 60 of the guide member 38. As shown in FIG. 10, the outer edge or surface 60 of the guide member 38 may be beveled to create a sharp edge 62 to penetrate the opposing inner surface or side 58 of the clamping channel or slot 10 thereby providing increased resistance to movement of the truss element positioning clamp 2. As further shown in FIG. 11, a lip 64 can be formed in guide member 38 to engage a corresponding lip 66 formed in the metal channel sheath or liner 15 (see FIGS. 2 and 7) thereby creating additional resistance to movement of the truss element positioning clamp 2.

It will be appreciated that the configuration and materials comprising clamping channels or slots 10 may vary between various truss fabrication tables 4 or within a single truss fabrication table 4. Depending on numerous factors such as the strength and hardness of the surface of a given clamping channel or slot 10, the substantially limited contact area of the clamp stop of the preferred embodiment may not provide an optimum resistance to the movement of the truss element positioning clamp.

Figure 15:
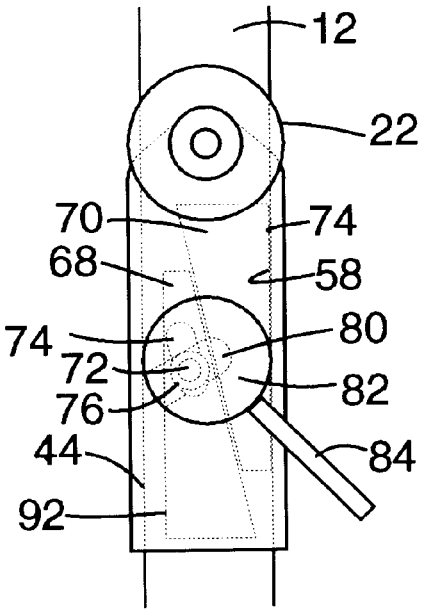
FIGS. 15 and 16 show top views of the truss element positioning clamp of the present invention shown in FIGS. 12 and 13 depicting operation of the sliding wedge shaped clamp stop.
Figure 16:
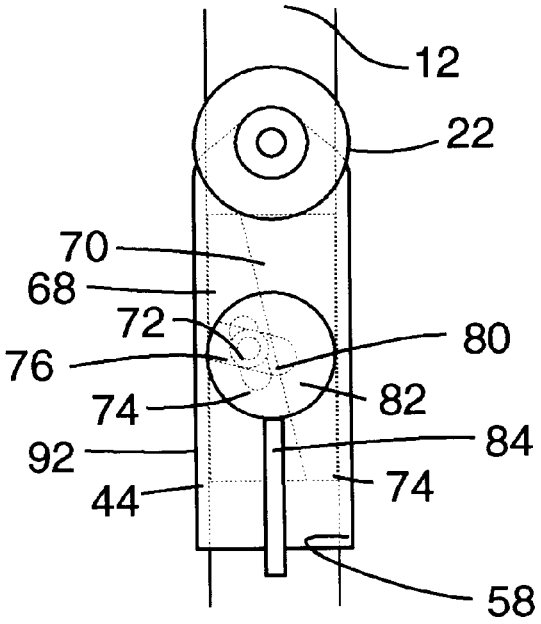
Figure 17:
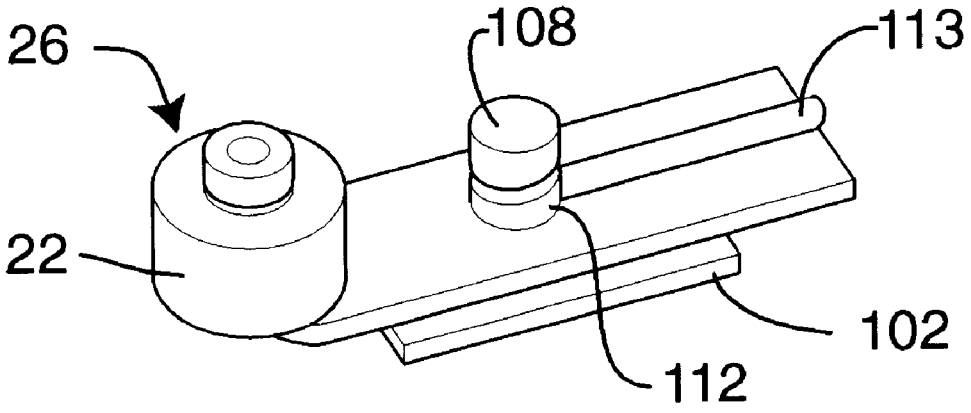
FIG. 17 is a perspective view of yet another alternate embodiment of the truss element positioning clamp of the present invention.

As shown in FIGS. 12 through 16, an alternative embodiment of the present invention provides a sliding wedge shaped clamp stop 68 with greater contact area in operative communication with a wedge shaped guide member 70 coupled to the lower surface 40 of the substantially flat clamp chassis 18. The wedge shaped clamp stop 68 is attached to the lower end 71 of shaft 72 received by a slot 74 formed in the substantially flat clamp chassis 18. The end of shaft 72 opposite the sliding wedge shaped clamp stop 68 terminates in a cap 76 slideably disposed on the upper surface 20 of the substantially flat clamp chassis 18. As shown in FIGS. 15 and 16, the cap 76 bridges across slot 74 and is received by a race 78 formed in the lower surface 80 of a hub 82 formed in the end portion of a handle 84. Hub 84 is rotationally disposed on the upper surface 20 of the substantially flat clamp chassis 18 by means of a fastening means or cap screw 86 received by a channel 87 formed in hub 84 and a corresponding threaded opening (not shown) in the substantially flat clamp chassis 18.

As shown in FIGS. 15 and 16, through the engagement of the outer edge or surface 88 of cap 76 with the inner cam surface 90 of the race 80, the rotational movement of hub 82 is translated into the linear motion of shaft 72 along the length of Slot 74 and a corresponding movement of the wedge shaped clamp stop 68. AS a result of the interaction between the inner cam surface 91 of the wedge shaped clamp stop 68 and the inner cam surface 93 of the wedge shaped guide member 70, the linear motion of shaft 72 is further translated into the lateral motion of the wedge shaped clamp stop 68 towards and away from the inner surface 44 of the clamping channel or slot 10. As a result, the wedge shaped clamp stop 68 may be selectively moved between a first position (FIG. 15) in which the outer edge or surface 92 of the wedge shaped clamp stop 68 is disengaged from the inner surface 44 of the clamping channel or slot 10 and a second position wherein the outer edge or surface 92 of the wedge shaped clamp stop 68 engages the inner surface 44 of the clamping channel or slot 10 resulting in a corresponding engagement of the outer surface 94 of the wedge shaped guide member 70 with the opposing inner surface 58 of the clamping channel or slot 10. AS with the preferred embodiment, it should be appreciated that the outer edge or surface 74 of the wedge shaped guide member 70 as well as the outer edge or surface 92 of the wedge shaped clamp stop 68 may be beveled or otherwise shaped and finished to provide a more positive engagement with the inner surfaces 44 and 58 of the clamping channel or slot 10.

Figure 18:
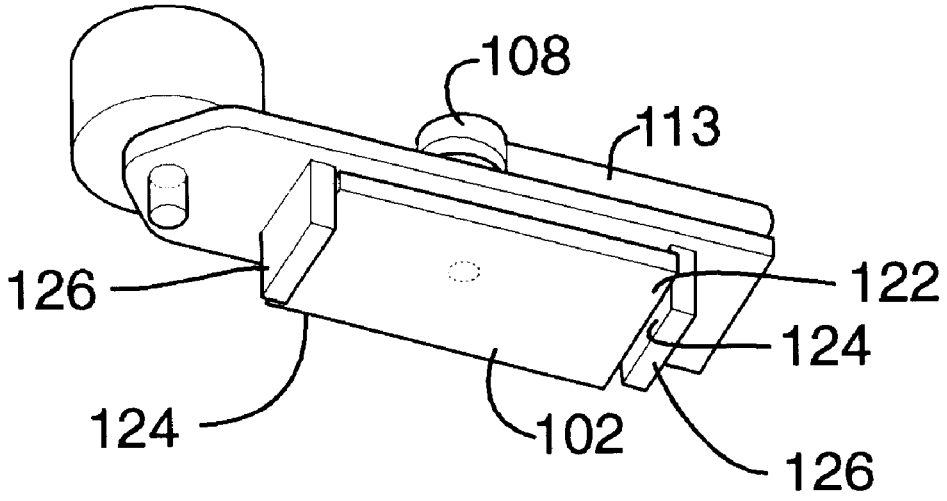
FIG. 18 is a bottom view of the truss element positioning clamp of the present invention shown in FIG. 17.
Figure 19:
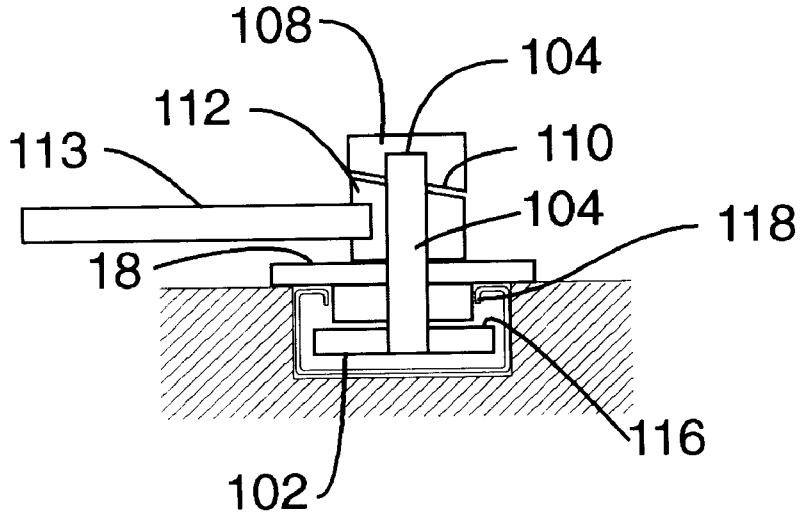
FIGS. 19 and 20 show end views of the truss element positioning clamp of the present invention shown in FIGS. 17 and 18 depicting operation of the clamp stop.
Figure 20:
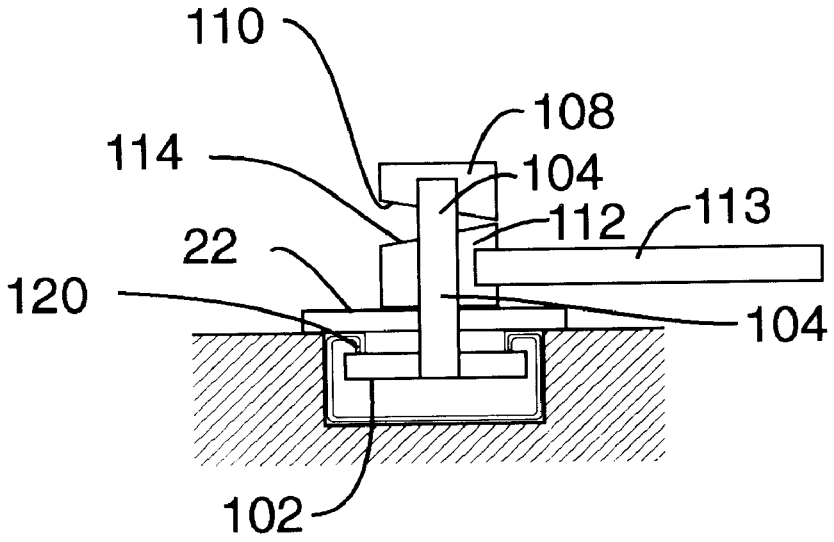

In some truss fabrication operations, it may be desirable to provide a truss element positioning clamp 2 to resist uplifting forces which might force the truss element positioning clamp 2 out of the clamping channel or slot 10. For such applications, another alternative embodiment of the truss element positioning clamp of the present invention is provided with a captive clamp stop generally indicated as 100 disposed within the clamping channel or slot 10. As shown FIGS. 17 through 20, a clamp stop 100 comprising a substantially flat plate 102 is disposed within the metal channel sheath or liner 15 of a clamping channel or slot 10. The substantially flat plate 102 is rigidly attached to a substantially vertical shaft 104 received by an aperture 106 formed in the substantially flat clamping chassis 18. As best shown in FIGS. 19 and 20, the substantially vertical shaft 104 includes a first collar 108 formed in the upper end portion thereof having an inclined lower surface 110. The vertical shaft 104 is disposed within a second collar 112 formed in the end portion of handle 113 positioned between the upper surface 20 of the substantially flat clamp chassis 18 and the collar 108. AS best shown in FIG. 20, the second collar 112 has an Inclined cam surface 114 in opposition to the inclined cam surface 110 of the first collar 108.

As shown in FIGS. 19 and 20, the interaction between the inclined cam surface 110 of the first collar 108 and the inclined cam surface 114 of the second collar 112 effectively translates the rotational motion of handle 113 into the vertical movement of the substantially vertical shaft 104 and the clamp stop 102. AS a result, through the selective rotation of handle 113 the clamp stop 102 is moveable between a first position (FIG. 19) in which the upper surface 116 of the clamp stop 102 is disengaged from the lower edge 118 of the metal channel sheath or liner 15 and a second position (FIG. 20) wherein the upper surface 116 of the clamp stop 102 engages the lower edge 118 of the metal channel sheath or liner 15 and compressing the lip 100 of the metal channel sheath or liner 15 between the clamp stop 102 and the substantially flat clamp chassis 18. As best shown in FIG. 18, any rotational forced translated from the handle 113 into the clamp stop 102 are effectively resisted by contact between the end portions 122 of the clamp stop 102 and the inner surfaces 124 of the guide members 126.

Figure 21:
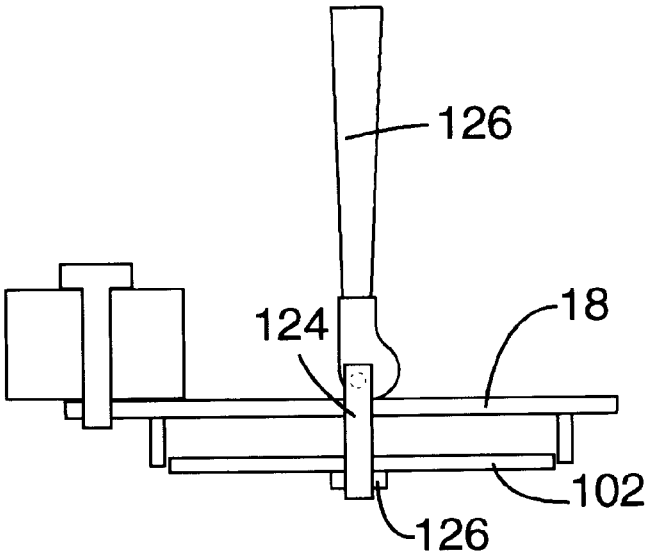
FIGS. 21 and 22 are end views of yet still another alternate embodiment of the truss element positioning clamp of the present invention.
Figure 22:
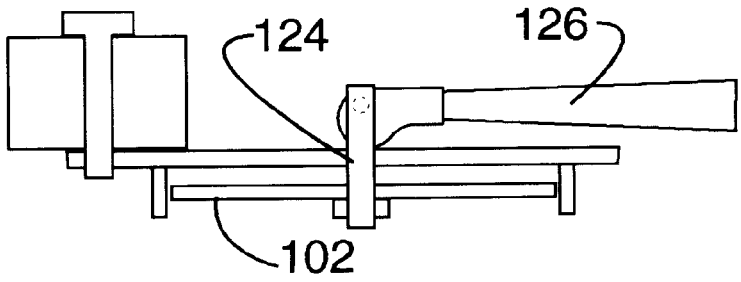

With reference to FIGS. 21 and 22, it can be appreciated that other alternative embodiments of the truss element positioning clamp 2 of the present invention may be possible. For example, as shown in FIGS. 21 and 22, a handle 127 with an integral cam surface 128 can be substituted for the handle 113 and the collars 108 and 112. In such an application, the substantially vertical shaft 104 is rotationally disposed within the clamp stop 102 by means of a cap 130. As a result, in the event handle 127 is left in an elevated position (FIG. 21) can rotate laterally away from the pinch roller into a lowered position (FIG. 22) rather than being damaged.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A truss element positioning clamp for use on a truss fabrication table to position a truss element in a preselected position comprising a clamp chassis slideably disposed over a clamping channel formed in the surface of the truss fabrication table including a truss stop operatively disposed on the upper surface of said clamp chassis to selectively engage and position the truss element of a truss having at least one guide member formed on said clamp chassis and disposed within the clamping channel to prevent rotation of said truss element positioning clamp relative to the clamping channel and a clamp stop movably coupled to said clamp chassis extending into the interior of the clamping channel and selectively movable between a first position and a second position such that when said clamp stop is in the first position the clamp stop is disengaged from the inner surface of the clamping channel whereby said truss element positioning clamp may be positioned longitudinally along the length of the clamping channel and when said clamp stop is in the second position said clamp stop engages the inner surface of the clamping channel preventing movement of said truss element positioning clamp to retain the truss element at a selected position on the surface of the truss fabrication table, and where said truss element positioning clamp includes a handle movable through a plane parallel to the upper surface of said clamping chassis attached to the upper portion of a substantially vertical shaft rotationally coupled to said clamp chassis and said clamp stop comprising a lobe of substantially circular horizontal cross section rigidly attached to the lower portion of said substantially vertical shaft.

2. The truss element positioning clamp of claim 1 where said clamp stop comprises a lobe of substantially circular horizontal cross section rigidly attached to the lower portion of said substantially vertical shaft in eccentric allignment therewith.

3. The truss element positioning clamp of claim 2 where the said truss stop comprises a substantially rectilinear block rotationally disposed on the upper surface of said clamp chassis.

4. The truss element positioning clamp of claim 3 where said substantially rectilinear block is rotationally coupled to said clamp chassis by a connecting means selectively moveable between a first position in which said substantially rectilinear block may be freely rotated through a plane parallel to the upper surface of said clamp chassis and second position wherein the rotational movement of said substantially rectilinear block relative to said clamping channel is prevented.

5. The truss element positioning clamp of claim 4, where corresponding ribs and or grooves are formed on the lower surface of said substantially rectilinear and upper surface of said clamp chassis to facilitate the tactile and discrete selection of angle between said substantially rectilinear block and said clamp chassis and or to prevent rotational movement of said substantially rectilinear block relative to said clamp chassis.

6. The truss element positioning clamp of claim 5 where indicia are inscribed on the upper surface of said clamp chassis to facilitate the selection of angle between said substantially linear block and said clamp chassis.

7. The truss element positioning clamp of claim 2 where said truss stop comprises a substantially cylindrical bobbin rotationally disposed on the upper surface of said clamp chassis.

8. The truss element positioning clamp of claim 2 where a lip is formed in said guide members to engage a corresponding lip formed in said clamping channel.

9. The truss element positioning clamp of claim 2 where the outer edge of said guide members is beveled to create a sharp edge to the inner surface of said clamping channel.

10. The truss element positioning clamp of claim 1 where said truss element positioning clamp includes a handle movable through a plane parallel to the upper surface of said clamping chassis with a race eccentrically disposed in the bottom surface of a hub formed on the end of said handle in sliding communication a vertical shaft disposed with a slot formed in said clamping channel and rigidly attached to said clamp stop slideably disposed on the lower surface of said clamp chassis.

11. The truss element positioning clamp of claim 10 where said guide member comprises a block of substantially trapezoidal horizontal cross section with the outer edge thereof being in substantially parallel alignment with the inner surface of said clamping channel and where said clamp stop comprises a substantially rectilinear block of trapezoidal horizontal cross section with the outer surface of said clamp stop being in substantially parallel alignment with the inner surface of said substantially rectilinear guide member and the inner surface of said stop member being in substantially parallel alignment with the inner surface of said guide member.

12. The truss element positioning clamp of claim 11 where the said truss stop comprises a substantially rectilinear block rotationally disposed on the upper surface of said clamp chassis.

13. The truss element positioning clamp of claim 12 where said substantially rectilinear block is rotationally coupled to said clamp chassis by a connecting means selectively moveable between a first position in which said substantially rectilinear block may be freely rotated through a plane parallel to the upper surface of said clamp chassis and second position wherein the rotational movement of said substantially rectilinear block relative to said clamping channel is prevented.

14. The truss element positioning clamp of claim 13 where corresponding ribs and or grooves are formed on the lower surface of said substantially rectilinear and upper surface of said clamp chassis to facilitate the tactile and discrete selection of angle between said substantially rectilinear block and said clamp chassis and or to prevent rotational movement of said substantially rectilinear block relative to said clamp chassis.

15. The truss element positioning clamp of claim 14 where indicia are inscribed on the upper surface of said clamp chassis to facilitate the selection of angle between said substantially linear block and said clamp chassis.

16. The truss element positioning clamp of claim 10 where said truss stop comprises a substantially cylindrical bobbin rotationally disposed on the upper surface of said clamp chassis.

17. The truss element positioning clamp of claim 10 where a lip is formed in said guide members to engage a corresponding lip formed in said clamping channel.

18. The truss element positioning clamp of claim 10 where the outer edge of said guide members is beveled to create a sharp edge to the inner surface of said clamping channel.

19. The truss element positioning clamp of claim 1 where said truss element positioning clamp includes a handle movable through a plane parallel to the upper surface of said clamping chassis attached to a collar of substantially rectilinear vertical cross section coaxially disposed about a substantially vertical shaft disposed within an opening formed in said clamp chassis with a cap of substantially rectilinear vertical cross section foamed on the upper end of said substantially vertical shaft with the lower surface of said cap and the upper surface of said being in substantially non-parallel alignment with the upper surface of said clamp chassis and said clamp stop comprising a substantially rectilinear block disposed on the lower end of said substantially vertical shaft where the outer edges of said clamp stop extend under lips formed on the inner surfaces of said clamping channel.

20. The truss element positioning clamp of claim 19 where the said truss stop comprises a substantially rectilinear block rotationally disposed on the upper surface of said clamp chassis.

21. The truss element positioning clamp of claim 20 where said substantially rectilinear block is rotationally coupled to said clamp chassis by a connecting means selectively moveable between a first position in which said substantially rectilinear block may be freely rotated through a plane parallel to the upper surface of said clamp chassis and second position wherein the rotational movement of said substantially rectilinear block relative to said clamping channel is prevented.

22. The truss element positioning clamp of claim 21 where corresponding ribs are formed on the lower surface of said substantially rectilinear and upper surface of said clamp chassis to facilitate the tactile and discrete selection of angle between said substantially rectilinear block and said clamp chassis and or to prevent rotational movement of said substantially rectilinear block relative to said clamp chassis.

23. The truss element positioning clamp of claim 21 where indicia are inscribed on the upper surface of said clamp chassis to facilitate the selection of angle between said substantially linear block and said clamp chassis.

24. The truss element positioning clamp of claim 19 where said truss stop comprises a substantially cylindrical bobbin rotationally disposed on the upper surface of said clamp chassis.

25. The truss element positioning clamp of claim 19 where a lip is formed in said guide members to engage a corresponding lip formed in said clamping channel.

26. The truss element positioning clamp of claim 19 where the outer edge of said guide members is beveled to create a sharp edge to the inner surface of said clamping channel.

27. The truss element positioning clamp of claim 1 where said truss element positioning includes a handle movable through a plane perpendicular to the upper surface of said clamping chassis including a hub formed in one end of said handle said hub having at least one substantially round edge in operative communication with the upper surface of said clamp chassis the hub being rotationally attached to a substantially vertical shaft in eccentric alignment with the axis of rotation of said handle, said vertical shaft being disposed within an opening formed in said clamp chassis and said clamp stop comprising a substantially rectilinear block disposed on the lower end of said substantially vertical shaft where the outer edges of said clamp stop extend under lips formed on the inner surfaces of said clamping channel.

28. The truss element positioning clamp of claim 27 where the said truss stop comprises a substantially rectilinear block rotationally disposed on the upper surface of said clamp chassis.

29. The truss element positioning clamp of claim 28 where said substantially rectilinear block is rotationally coupled to said clamp chassis by a connecting means selectively moveable between a first position in which said substantially rectilinear block may be freely rotated through a plane parallel to the upper surface of said clamp chassis and second position wherein the rotational movement of said substantially rectilinear block relative to said clamping channel is prevented.

30. The truss element positioning clamp of claim 29 where corresponding ribs and or grooves are formed on the lower surface of said substantially rectilinear and upper surface of said clamp chassis to facilitate the tactile and discrete selection of angle between said substantially rectilinear block and said clamp chassis and or to prevent rotational movement of said substantially rectilinear block relative to said clamp chassis.

31. The truss element positioning clamp of claim 29 where indicia are inscribed on the upper surface of said clamp chassis to facilitate the selection of angle between said substantially linear block and said clamp chassis.

32. The truss element positioning clamp of claim 27 where said truss stop comprises a substantially cylindrical bobbin rotationally disposed on the upper surface of said clamp chassis.

33. The truss element positioning clamp of claim 27 where a lip is formed in said guide members to engage a corresponding lip formed in said clamping channel.

34. The truss element positioning clamp of claim 27 where the outer edge of said guide members is beveled to create a sharp edge to the inner surface of said clamping channel.

35. The truss element positioning clamp of claim 1 where the said truss stop comprises a substantially rectilinear block rotationally disposed on the upper surface of said clamp chassis.

36. The truss element positioning clamp of claim 35 where said substantially rectilinear block is rotationally coupled to said clamp chassis by a connecting means selectively moveable between a first position in which said substantially rectilinear block may be freely rotated through a plane parallel to the upper surface of said clamp chassis and second position wherein the rotational movement of said substantially rectilinear block relative to said clamping channel is prevented.

37. The truss element positioning clamp of claim 36 where corresponding ribs and or grooves are formed on the lower surface of said substantially rectilinear and upper surface of said clamp chassis to facilitate the tactile and discrete selection of angle between said substantially rectilinear block and said clamp chassis and or to prevent rotational movement of said substantially rectilinear block relative to said clamp chassis.

38. The truss element positioning clamp of claim 36 where indicia are inscribed on the upper surface of said clamp chassis to facilitate the selection of angle between said substantially linear block and said clamp chassis.

39. The truss element positioning clamp of claim 1 where said truss stop comprises a substantially cylindrical bobbin rotationally disposed on the upper surface of said clamp chassis.

40. The truss element positioning clamp of claim 1 where a lip is formed in said guide members to engage a corresponding lip formed in said clamping channel.

41. The truss element positioning clamp of claim 1 where the outer edge of said guide members is beveled to create a sharp edge to the inner surface of said clamping channel.

* * * * *